US006752343B2

(12) United States Patent
Nagai et al.

(10) Patent No.: US 6,752,343 B2
(45) Date of Patent: Jun. 22, 2004

(54) WINDING FABRICATION METHOD AND APPARATUS FOR ELECTRIC COILS

(75) Inventors: Masahiro Nagai, Kawasaki (JP); Shiro Hasegawa, Kawasaki (JP)

(73) Assignee: Showa Electric Wire & Cable Co., Ltd. (JP)

( * ) Notice: Subject to any disclaimer, the term of this patent is extended or adjusted under 35 U.S.C. 154(b) by 0 days.

(21) Appl. No.: 10/254,602

(22) Filed: Sep. 26, 2002

(65) Prior Publication Data

US 2003/0098380 A1 May 29, 2003

(30) Foreign Application Priority Data

Nov. 29, 2001 (JP) ..... 2001-365105

(51) Int. Cl.[7] ..... B21C 47/02; B65H 81/06
(52) U.S. Cl. ..... 242/443; 29/596
(58) Field of Search ..... 242/436, 437, 242/443, 444, 448; 29/605

(56) References Cited

U.S. PATENT DOCUMENTS 3,747,205 A * 7/1973 Moore ..... 29/605
3,886,029 A * 5/1975 Poulsen ..... 242/444
6,401,333 B1 * 6/2002 Suzuki et al. ..... 29/848

FOREIGN PATENT DOCUMENTS

JP 358102510 A * 6/1983 ..... 242/443
JP 358173818 A * 10/1983 ..... 242/443
JP 359041819 A * 3/1984 ..... 242/437.3
JP 359114809 A * 7/1984 ..... 242/437.3
JP 359115508 A * 7/1984 ..... 242/444
JP 361084010 A * 4/1986 ..... 2442/437.3
JP 63222412 A * 9/1988 ..... 242/437.3
JP 401014910 A * 1/1989 ..... 242/443
JP 401282810 A * 11/1989 ..... 242/437.3
JP 402079406 A * 3/1990 ..... 242/443

* cited by examiner

*Primary Examiner*—Emmanuel Marcelo
(74) *Attorney, Agent, or Firm*—Lorusso, Loud & Kelly

(57) ABSTRACT

A conductor wire material CW is wound into an accurate size without causing floating and deformation when an electric coil is formed. When the conductor wire material CW supplied from a wire material feed portion 3 is wound by turning a coil-winding mold 4 and is processed to fabricate an electric coil having a desired coil shape, the coil-winding mold 4 is linearly moved in a direction D away from the wire material feed portion 3 by a distance corresponding to a major side portion 40*a* to impart predetermined tension to the conductor wire material CW when a winding portion 40 of the coil-winding mold 4 on which the conductor wire material is wound is the major side portion 40*a*, and the coil-winding mold 4 is rotated when the winding portion 40 of the coil-winding mold 4 on which the conductor wire material is wound is a minor side portion 40*b*.

7 Claims, 5 Drawing Sheets

(A)

(B)

(A)

(B)

WINDING FABRICATION METHOD AND APPARATUS FOR ELECTRIC COILS

BACKGROUND OF THE INVENTION

1. Field of the Invention

This invention relates to a winding fabrication method and apparatus for electric coils. More particularly, the invention relates to a winding fabrication method and apparatus for winding a conductive wire material by use of a rotary mechanism and forming an electric coil.

2. Description of the Related Art

A winding fabrication apparatus has been used in the past to fabricate a driving coil of a voice coil motor used for a linear motor for achieving linear driving and an induction heating coil for radio frequency induction heating into a winding state.

This winding fabrication apparatus includes a wire material feed portion 52 to which a bobbin 51 having a conductor wire material CW wound thereon is rotatably fitted, and a mold rotating portion 54 to which a coil-winding mold 53 for winding the conductor wire material CW is fitted and which drives and rotates the coil-winding mold 53, as shown in FIG. 5 of the accompanying drawings. Incidentally, the conductor wire material CW wound on the winding portion 530 of the coil-winding mold 53 is generally shaped to a straight angle so that winding can be easily conducted.

When the mold rotating portion 54 of the winding fabrication apparatus 50 rotates the coil-winding mold 53, the conductor wire material CW wound on the bobbin 51 fitted to the wire feed portion 52 is wound on the winding portion 530 of the coil-winding mold 53, and an electric coil in the winding form can be fabricated.

The driving coil of the voice coil motor and the induction-heating coil mostly have a rectangular shape or an elliptic shape. Therefore, the winding portion 530 of the coil-winding mold 53 fitted to the mold-rotating portion 54 is formed into a shape capable of forming the rectangular or elliptic shape. When the mold-rotating portion 54 rotates the coil-winding mold 53 having the rectangular or elliptic winding portion 530, an electric coil having a rectangular or elliptic shape can be acquired.

When the mold-rotating portion 54 rotates the coil-winding mold 53 having the winding portion 530 shaped into the rectangle or ellipse in the winding fabrication apparatus 50 described above, however, the conductor wire material CW supplied from the wire material feed portion 52 moves from a position A to a position A' and then to a position A" in FIG. 5. In other words, since the moving distance of the conductor wire material CW supplied from the wire material feed portion 52 from the position A gets elongated, large tension is imparted to the conductor wire material CW at a minor side portion 530*a*. At a major side portion 530*b*, on the other hand, small tension is imparted because the moving distance of the conductor wire material CW supplied from the wire material feed portion 52 from the position A is small. In consequence, the conductor wire material CW cannot be tightly wound in some cases at the major side portion 530*b* of the winding portion 530.

Consequently, the winding WI is tightly wound on the winding portion 530 at the minor side portion 530*a* as shown in FIG. 6A but is loose at the major side portion 530*b*, creating a gap with the winding portion 530. In this way, the conductor wire material CW undergoes floating and deformation and is not sometimes wound into an accurate size.

When the winding WI is rolled (press molded) towards the major side portion 530*b* of the winding portion 530 as shown in FIG. 6B, the gap occurring at this major side portion 530*b* can be prevented. However, because the winding WI is elongated at the minor side portion 530*a*, dimensional accuracy gets deteriorated.

SUMMARY OF THE INVENTION

To solve the problems with the prior art described above, the invention is directed to provide a winding fabrication method and apparatus for electric coils that can wind a conductor wire material into an accurate size without causing floating and deformation.

To accomplish the object described above, the invention provides a winding fabrication method for electric coils for winding a conductor wire material supplied from a wire material feed portion into an electric coil having a desired coil shape by turning a coil-winding mold having a winding portion that is formed into a shape having a linear portion having a predetermined length, the method comprising the step of linearly moving the coil-winding mold in a direction away from the wire material feed portion and imparting predetermined tension to the conductor wire material when the conductor wire material is wound on the linear portion of the coil-winding mold having the predetermined length.

According to the winding fabrication method for electric coils of the invention, the coil-winding mold is moved linearly in a direction away from the wire material feed portion to impart the predetermined tension to the conductor wire material when the conductor wire material is wound on the linear portion of the coil-winding mold having the predetermined length, whereby it becomes possible that the conductor wire material to be wound on the linear portion of the coil-winding mold is prevented from being floating from the coil-winding mold.

When the shape of the winding portion of the coil-winding mold is polygonal in the winding fabrication method for electric coils according to the invention, the coil-winding mold is linearly moved at a linear portion having a predetermined length in a direction away from a wire material feed portion by a distance corresponding to the length of the linear portion having the predetermined length, and is rotated at a corner. When the polygon as the shape of the winding portion of the coil-winding mold is a rectangle, the coil-winding mold is linearly moved at a major side portion as the linear portion having the predetermined length in the direction away from the wire material feed portion by a distance corresponding to the length of the linear portion having the predetermined length, and is rotated at a corner and a minor side portion. When the shape of the winding portion of the coil-winding mold is an ellipse, the coil-winding mold is linearly moved at the linear portion having the predetermined length away from the wire material feed portion by a distance corresponding to the length of the linear portion having the predetermined length, and is rotated at a semi-circle portion. Since it becomes possible in this way to prevent the winding position of the conductor wire material supplied from the wire material feed portion from deviating from the wire material feed portion, it becomes also possible to prevent the change of tension imparted to the conductor wire material depending on the position of the winding portion of the coil-winding mold.

When the conductor wire material is wound on the winding portion of the coil-winding mold in the winding fabrication method for electric coils according to the invention, the conductor wire material is preferably rolled towards the coil-winding mold. Since the conductor wire material can be thus wound under a stable condition on the coil-winding mold, the electric coil can be wound uniformly.

A winding fabrication apparatus for electric coils according to the invention for accomplishing the object described above is a winding fabrication apparatus for winding a conductor wire material supplied from a wire material feed portion into an electric coil having a desired coil shape by turning a coil-winding mold having a winding portion that is shaped into a shape having a linear portion having a predetermined length, wherein: when the winding portion to which the coil-winding mold is fixed and on which the conductor wire material is wound is the linear portion having the predetermined length, the apparatus includes a linear moving mechanism for linearly moving the coil-winding mold in a direction away from the wire material feed portion by a distance corresponding to the length of the linear portion having the predetermined length, and imparting predetermined tension to the conductive wire material, and a rotary base for fixing the linear moving mechanism; and when the winding portion on which the conductive wire material is wound is different from the linear portion having the predetermined length, such as a corner, the apparatus includes a rotary mechanism for rotating the rotary base to which the linear moving mechanism is fixed.

According to the winding fabrication apparatus for electric coils described above, when the conductor wire material is wound on the coil-winding mold, the linear moving mechanism linearly moves the coil-winding mold at the linear portion having the predetermined length of the winding portion of the coil-winding mold by a distance corresponding to the length of the linear portion, and when the winding portion is different from the linear portion having the predetermined length such as a corner, the rotating mechanism rotates the rotary base at an angle of rotation corresponding to the portion different from the linear portion. Since it becomes thus possible to prevent the winding position of the conductor wire material supplied from the wire material feed portion from deviating from the linear material feed portion, it becomes also possible to prevent the change of tension imparted to the conductor wire material depending on the position of the winding portion of the coil-winding mold.

When the conductor wire material is wound on the coil-winding mold in the winding fabrication apparatus for electric coils according to the invention, the apparatus preferably includes a pressure roller for rolling the conductor wire material towards the coil-winding mold. In this case, the electric coil can be uniformly wound because it can be wound under the stable condition on the winding portion of the coil-winding mold.

BRIEF DESCRIPTION OF THE DRAWINGS

FIG. 2 is an explanatory view useful for explaining a winding fabrication apparatus for an electric coil according to a preferred embodiment of the invention, wherein FIG. 2A is an overall perspective view and FIG. 2B is a detailed view of a winding portion of a coil-winding mold;

FIG. 4 is a perspective view showing a winding portion of a coil-winding mold used for an winding fabrication apparatus for an electric coil according to the invention and an electric oil fabricated by the coil winding mold, wherein FIG. 4A is a perspective view and FIG. 4B is a sectional view;

FIG. 6 is an explanatory view showing a winding fabrication method and an apparatus for electric coils according to the prior art, wherein FIG. 6A is an explanatory view showing a state of a winding portion and winding of a coil-winding mold and FIG. 6B is an explanatory view showing a state of the winding portion and the winding of the coil winding mold when press molding is further made.

DESCRIPTION OF THE PREFERRED EMBODIMENTS

A winding fabrication method and apparatus for electric coils according to preferred embodiments of the invention will be hereinafter explained with reference to the accompanying drawings.

Figure 1:
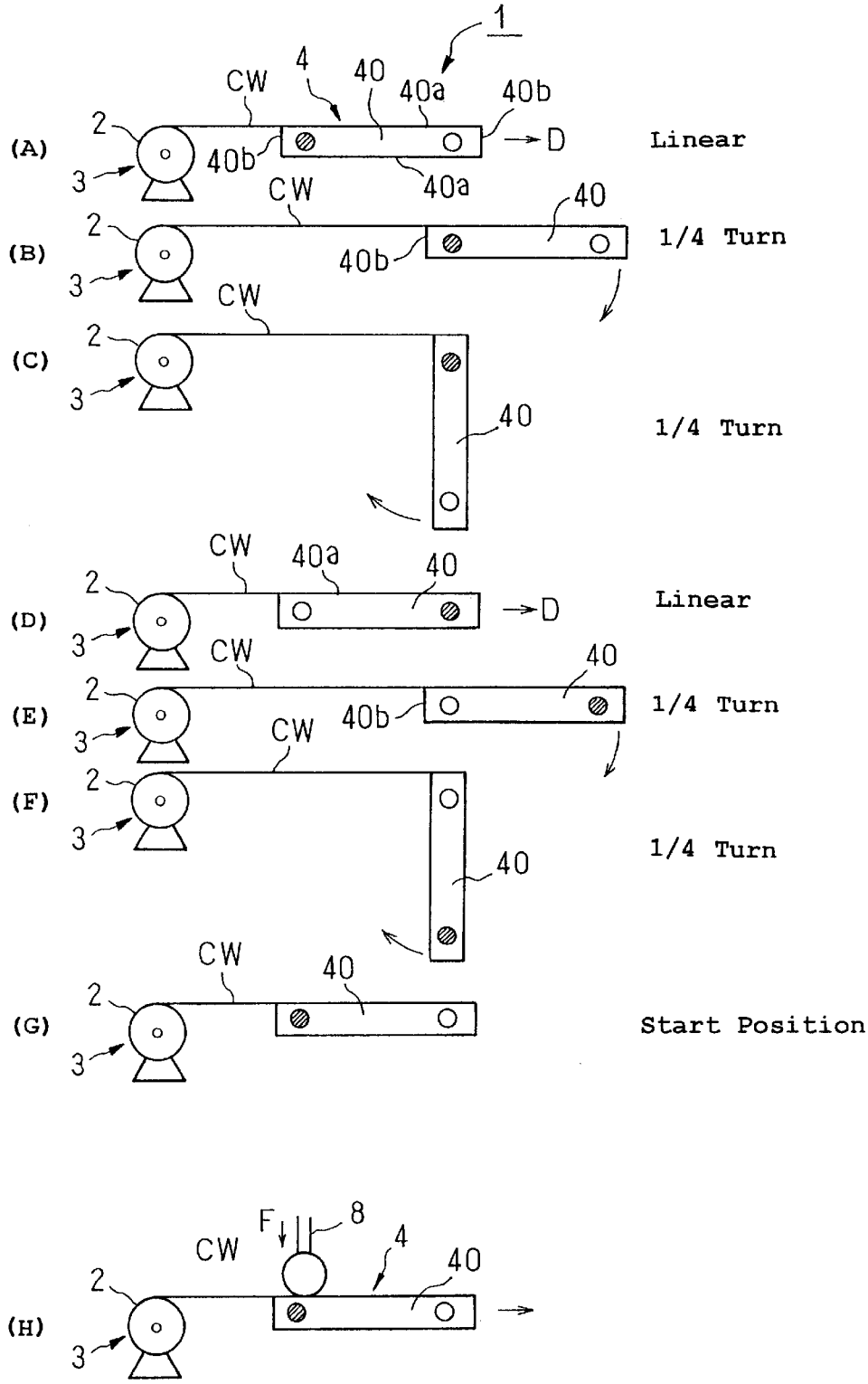
FIG. 1 is an explanatory view useful for explaining a winding fabrication method for an electric coil according to a preferred embodiment of the invention.

FIG. 1 shows a winding fabrication apparatus to which a winding fabrication method of electric coils according to the invention is applied. The apparatus winds a conductor wire material CW supplied from a wire material feed portion 3, to which a bobbin 2 having the conductor wire material CW such as a Lizendraht (litz) wire wound is rotatably fitted, by turning a coil-winding mold 4 having a linear portion having a predetermined length, such as a rectangular winding portion, and processes the conductor wire material CW into an electric coil having a rectangular coil shape. Incidentally, the conductor wire material CW wound on the winding portion of the coil-winding mold 4 is generally processed into a straight angle so that a winding operation can be easily carried out.

Figure 2:
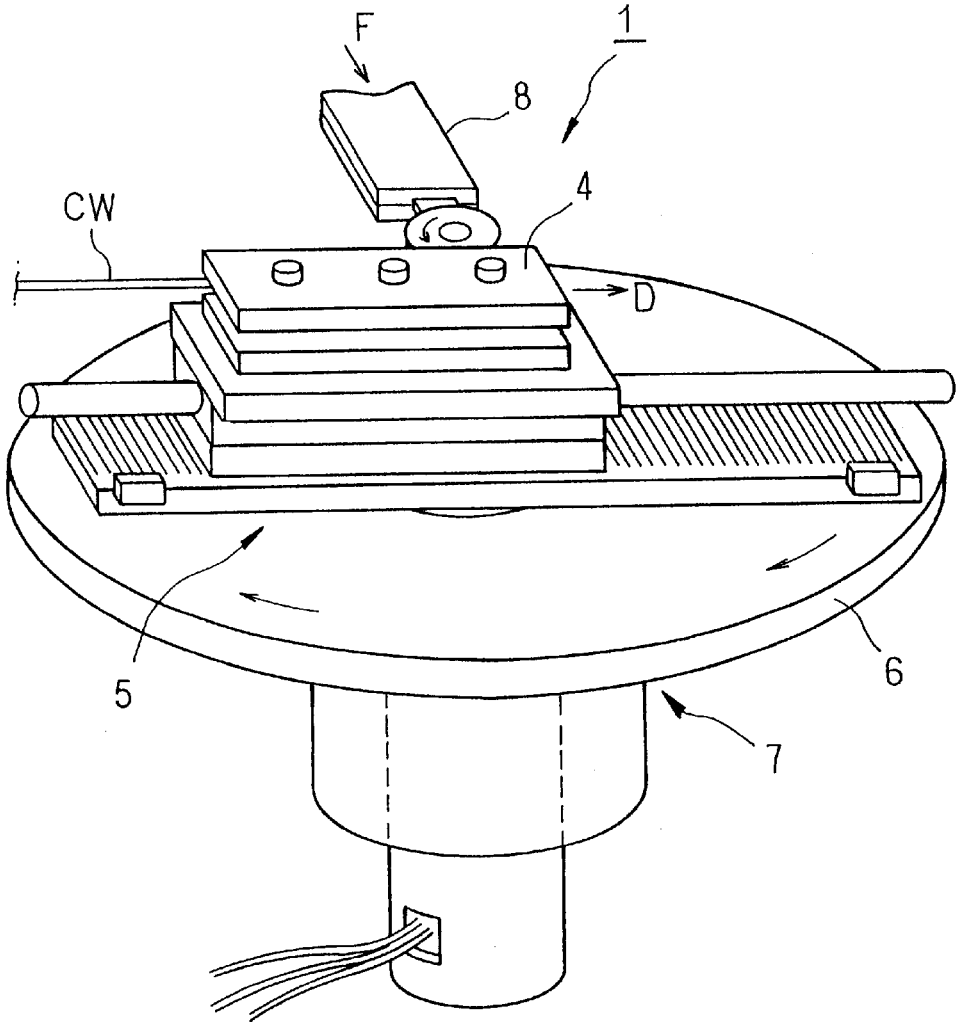
Figure 2:
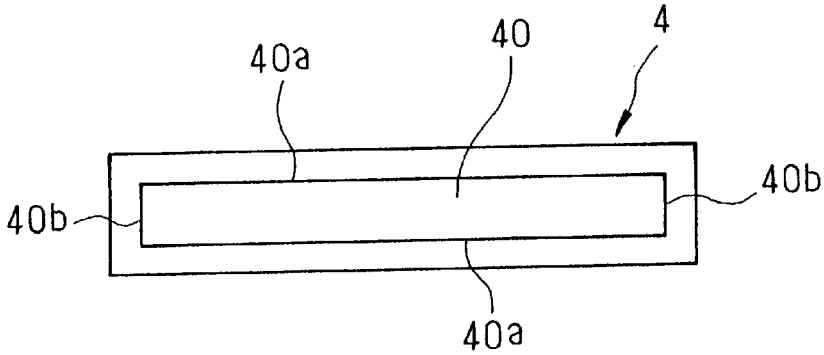

According to a preferred embodiment of the invention, this winding fabrication apparatus includes a linear moving mechanism 5 and a rotary mechanism 7 as shown in FIG. 2, for example. The linear moving mechanism 5 moves the coil-winding mold 4 in a direction D away from the wire material feed portion 3 (see FIG. 1) by a distance corresponding to the length of a linear portion 40*a* having a predetermined length, and imparts predetermined tension to the conductor wire material CW when the winding portion 40 to which the coil winding mold 4 is fixed and on which the conductor wire material CW of the coil-winding mold 4 is wound is a major side portion 40*a*. The rotary mechanism 7 turns a rotary base 6 for fixing the linear moving mechanism 5. Namely, when the winding portion 40 on which the conductor wire material CW of the coil winding-mold 4 is wound is a minor side portion 40*b*, the linear moving mechanism 5 is fixed to the rotary base 6.

The linear moving mechanism 5 may be the linear motor shown in the drawing or a unit comprising the combination of a ball screw with a motor or an air cylinder that can linearly move the coil-winding mold 4 to be fixed. Positioning means such as a limit switch is used to decide the movement position. Examples of the linear motor include a multi-polar brush-less motor and a voice coil motor, and examples of the motor include a stepping motor, a DC servo motor and an AC servo motor. Incidentally, it is advisable to juxtapose a linear guide such as a ball screw to achieve high-precision linear guide when the linear motor or the air cylinder linearly moves the coil-winding mold 4.

The rotary mechanism 7 is suitably a unit comprising the combination of the motor described above with a gear box or a direct drive motor that decides an angle of rotation by a high-resolution detector. When the rotary base 6 fixed to the rotary mechanism 7 is driven for rotation, the coil-winding mold 4 is rotated.

The winding fabrication apparatus further includes a pressure roller 8 for rolling the conductor wire material CW to the coil-winding mold 4 when it is wound on the winding portion 40 of the coil-winding mold 4.

To fabricate an electric coil having a rectangular coil shape by use of the winding fabrication apparatus 1 having such a construction, for example, the linear moving mechanism 5 moves the coil-winding mold 4 towards the wire material feed portion 3 so that the coil-winding mold 4 having a rectangular shape can be wound on one of the major side portions 40*a* of the winding portion 40 of the coil-winding mold 4 (the upper major side portion 40*a* of the winding portion 40 of the coil winding-mold 4 shown in FIG. 1A). The linear moving mechanism 5 then sets the coil-winding mold 4 to the start position (FIG. 1A). The conductor wire material CW wound on the bobbin 2 of the wire material feed portion 3 is fixed under this state to the right end of the coil-winding mold 4 in FIG. 1A, and the winding process is started.

More concretely, the linear moving mechanism 5 moves the coil-winding mold 4 in the direction D away from the wire material feed portion 3 (to the right in FIG. 1A) by the distance corresponding to the length of the major side portion 40*a* of the winding portion 40 of the coil winding mold 4 and imparts predetermined tension to the conductor wire material CW (FIGS. 1A and 1B). This predetermined tension is set to a value such that after the conductor wire material CW is wound, the conductor wire material CW so wound does not float from the major side portion 40*a* of the winding portion 40 of the coil-winding mold 4. To wind the conductive wire material CW on one of the minor side portions 40*b* of the winding portion 40 of the coil winding mold 4 (the minor side portion 40*b* on the left side of the winding portion 40 in FIG. 1B) after this linear movement, the rotary mechanism 7 rotates the rotary base 6, to which the linear moving mechanism 5 is fixed, ¼ turn clockwise in FIG. 1B and ¼ turn clockwise in FIG. 1C, or ½ turn in total (FIGS. 1B and 1C). To wind next the conductor wire material CW on the other major side portion 40*a* of the winding portion 40 of the coil winding mold 4 after this rotary movement, the linear moving mechanism 5 moves the coil-winding mold 4 in the direction D away from the wire material feed portion 3 (to the right in FIG. 1D) by the distance corresponding to the length of the major side portion 40*a* of the winding portion 40 of the coil winding mold 4 and imparts predetermined tension to the conductor wire material CW (FIGS. 1D and 1E). To wind the conductor wire material CW on the other minor side portion 40*b* of the winding portion 40 of the coil-winding mold 4 after this linear movement, the rotary mechanism 7 rotates the rotary base 6, to which the linear moving mechanism 5 is fixed, ¼ turn clockwise in FIG. 1E and ¼ turn clockwise in FIG. 1F, or ½ turn in total (FIGS. 1E and 1F). The winding steps described so far complete winding of one turn and the coil-winding mold 4 returns to the start position (FIG. 1G).

When the conductor wire material CW is wound on the winding portion 40 of the coil-winding mold 4, the pressure roller 8 always rolls the conductor wire material CW to the coil-winding mold 4 (FIG. 1H). Therefore, the conductor wire material CW can be stably wound on the winding portion 40 of the coil-winding mold 4, and the electric coil can be uniformly wound.

The electric coil having a desired winding state can be formed when the winding steps described above are thereafter repeated in accordance with the number of turns of the conductor wire material CW.

As described above, the linear moving mechanism 5 linearly moves the coil-winding mold 4 in the direction D away from the wire material feed portion 3 by the distance corresponding to the length of the major side portion 40*a* when the winding portion 40 exists at the major side portion 40*a,* and can rotate the rotary base 6 at the angle corresponding to the minor side portion 40*b* when the winding portion 40 exists at the minor side portion 40*b*. Therefore, the invention can prevent fluctuation of the winding position of the conductor wire material CW supplied from the wire material feed portion 3 from this wire material feed portion 3. In other words, it is possible to prevent the change of the tension imparted to the conductor wire material CW depending on the position of the winding portion 40 of the coil-winding mold 4, and to provide an electric coil having a high occupation ratio.

In the preferred embodiment of the invention described above, the winding portion of the coil-winding mold has the rectangular shape, but this shape is not particularly restrictive but may be any polygon or an ellipse. In the case of the elongated circle, the circle comprises major side portions and semi-circle portions. Therefore, an electric coil having a desired winding state can be formed by conducting the same winding step for the semi-circle portions as that of the minor side portions of the rectangle, that is, when the coil-winding mold is turned ½ turn.

Figure 3:
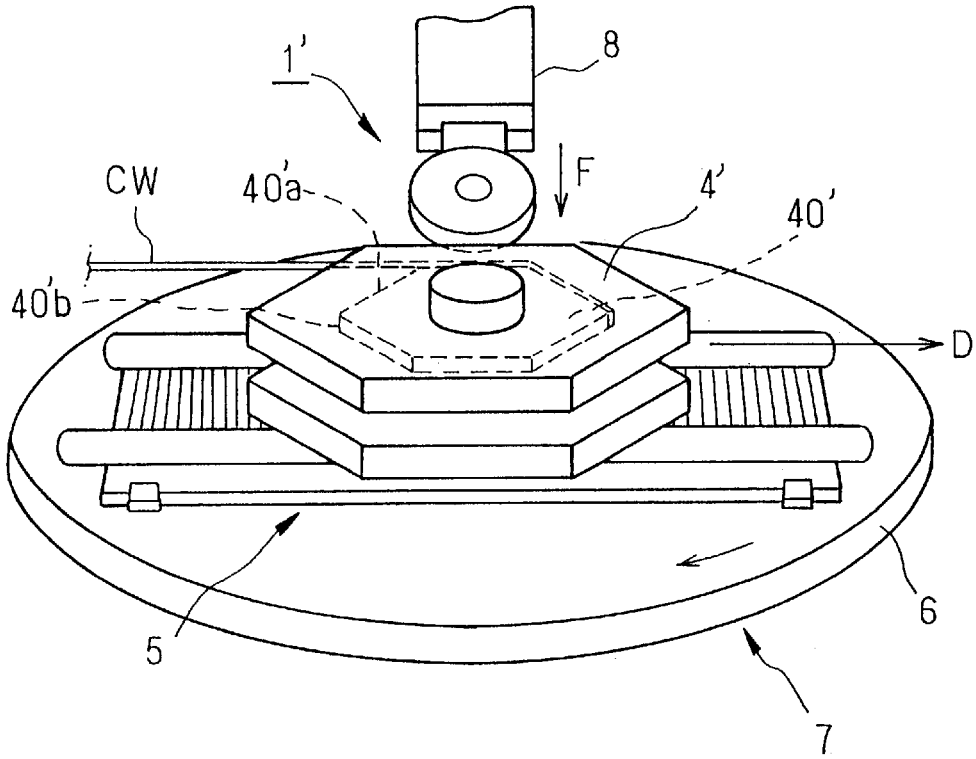
FIG. 3 is an overall perspective view of a winding fabrication apparatus for an electric coil according to another preferred embodiment of the invention.
Figure 3:
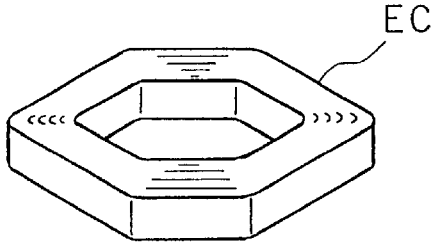

On the other hand, when the shape of the winding portion of the coil-winding mold is hexagonal, for example, the following construction is employed. Namely, the coil-winding mold 4' is fixed to the linear moving mechanism 5 in such a fashion as to be capable linearly moving as shown in FIG. 3A, and the linear moving mechanism 5 is in turn fixed to the rotary base 6 of the rotary mechanism 7.

In this winding fabrication apparatus 1', the linear moving mechanism 5 moves the coil-winding mold 4' in the direction D away from the wire material feed portion 3 (FIG. 1) by the distance corresponding to the length of the linear portion 40'*a* of the coil-winding mold 4' when the winding portion 40' of the coil-winding mold 4' exists at the linear portion 40'*a* and imparts predetermined tension to the conductor wire material CW. When this winding portion 40' exists at the corner 40'*b,* the rotary mechanism 7 rotates the rotary base 6 at an angle of rotation corresponding to the inner angle of the corner 40'*b*. In consequence, it becomes possible to prevent the winding position of the conductor wire material CW supplied from the wire material feed portion 3 from changing from the wire material feed portion 3, and to prevent the change of the tension imparted to the conductor wire material CW depending on the position of the winding portion 40' of the coil-winding mold 4'. A hexagonal electric coil EC having a high occupation ratio can thus be obtained as shown in FIG. 3B.

EXAMPLE

The following experiment is carried out by use of the winding fabrication method and apparatus for electric coils according to the embodiment of the invention described above.

Figure 4:
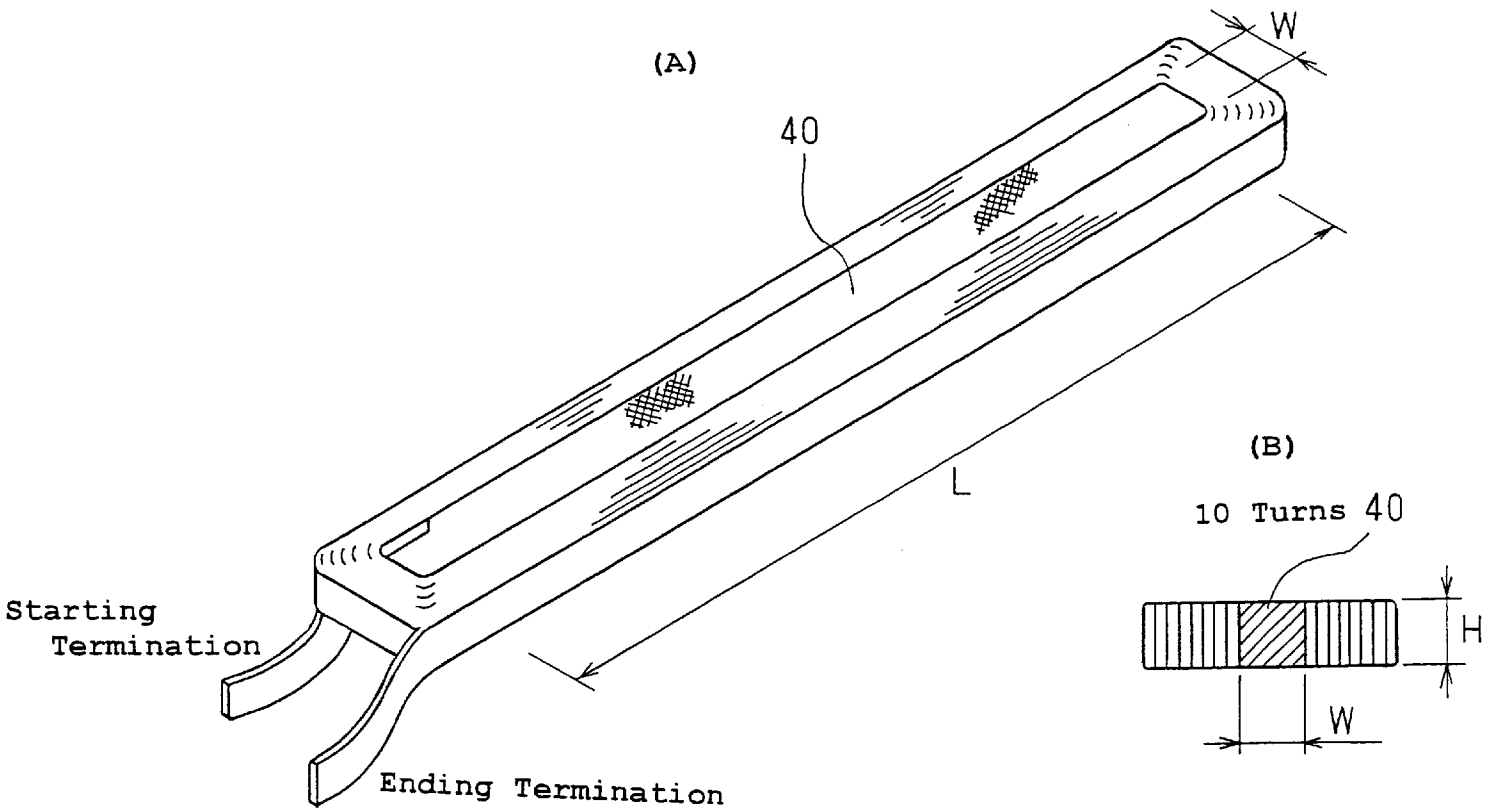
Figure 5:
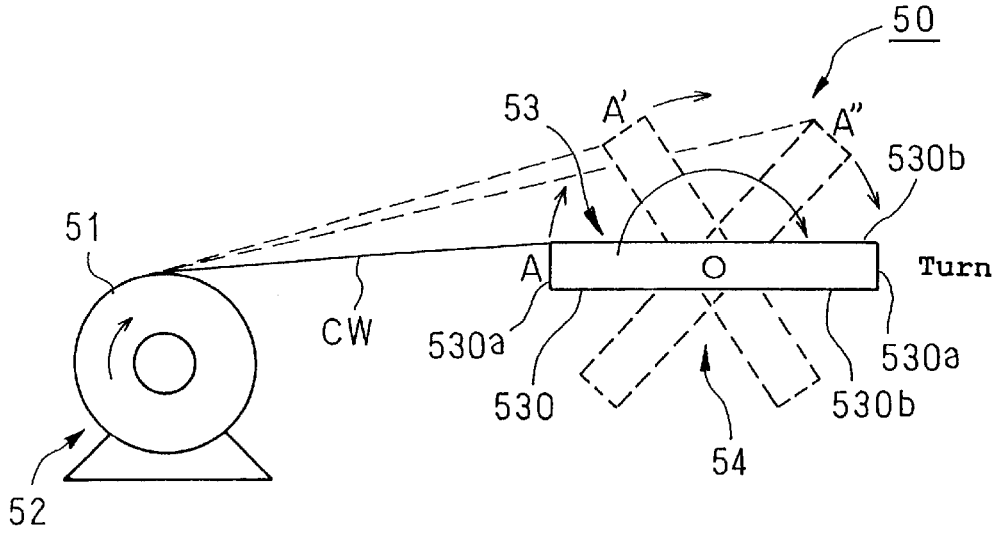
Fig. 5 Related Art
FIG. 5 is an explanatory view showing a winding fabrication method and an apparatus for electric coils according to the prior art.
Figure 6:
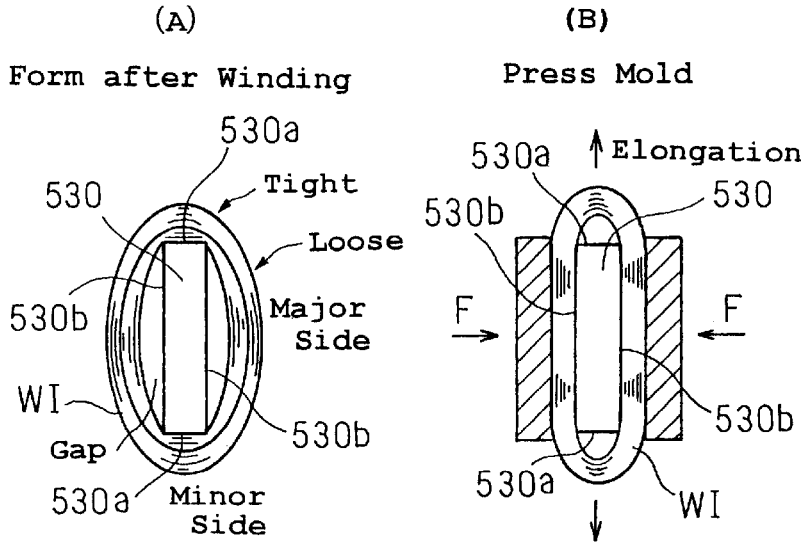
Fig. 6 Related Art

The electric coil formed in this example is obtained in the following way. A Litzendraht (litz) wire having an outer diameter of 3.2 mm and obtained by twisting 100 wires of two-kind EIW wires (polyesterimide copper wires having two kinds of coatings) having a diameter of 0.25 mm is primary rolled into a straight angle having a width of 8.5 mm. While this wire is wound on the winding portion 40 of the coil-winding mold, it is secondarily rolled by use of a pressure roller so that the wire can be wound into a rectangle as shown in FIGS. 4A and 4B.

The winding portion 40 of the coil-winding mold has a height H of 8.5 mm, a width W of 20 mm and a length L of 350 mm.

The linear moving mechanism of the winding fabrication apparatus has a maximum linear driving stroke of 400 mm and a moving speed of up to 1.5 seconds. The rotary mechanism has a maximum radius of rotation of 400 mm and a rotating speed of up to 2.0 seconds. Further, the pressure of the pressure roller is 10 Kgf.

When the litz wire converted to a straight angle of a width of 8.5 mm is wound under the condition described above, an electric coil having 10 turns can be accurately finished within 65 seconds without floating of the litz wire at all.

As explained above, when the conductor wire material is wound on the linear portion of the winding portion of the coil-winding mold which linear portion has a predetermined length, the winding fabrication method and apparatus for electric coils according to the invention can linearly move the coil-winding mold in the direction away from the wire material feed portion and can impart predetermined tension to the conductor wire material. In consequence the winding fabrication method and apparatus can wind the conductor wire material into an accurate size without causing floating and deformation.

What is claimed is:

1. A winding fabrication method for electric coils for winding a conductor wire material supplied from a wire material feed portion into an electric coil having a desired coil shape by turning a coil-winding mold having a winding portion formed into a shape having a linear portion having a predetermined length, comprising the step of:

linearly moving said coil-winding mold in a direction away from said wire material feed portion and imparting predetermined tension to said conductor wire material when said conductor wire material is wound on said linear portion of said coil-winding mold having the predetermined length.

2. A winding fabrication method of electric coils according to claim 1, wherein, when said winding portion of said coil-winding mold has a polygonal shape, said coil-winding mold is linearly moved at said linear portion having the predetermined length in a direction away from said wire material feed portion by a distance corresponding to the length of said linear portion having the predetermined length, and is rotated at corner portions.

3. A winding fabrication method of electric coils according to claim 2, wherein, when said polygonal shape of said winding portion of said coil-winding mold is a rectangle, said coil-winding mold is linearly moved at major side portions as said linear portion having the predetermined length in a direction away from said wire material feed portion by a distance corresponding to the length of said linear portion having the predetermined length, and is rotated at minor side portions.

4. A winding fabrication method of electric coils according to claim 1, wherein, when said winding portion of said coil-winding mold has an elliptic shape, said coil-winding mold is linearly moved at said linear portion having the predetermined length in a direction away from said wire material feed portion by a distance corresponding to the length of said linear portion having the predetermined length, and is rotated at semi-circle portions.

5. A winding fabrication method of electric coils according to claim 1, wherein, when said conductor wire material is wound on said winding portion of said coil-winding mold, said conductor wire material is rolled towards said coil-winding mold.

6. A winding fabrication apparatus for electric coils for winding a conductor wire material supplied from a wire material feed portion into an electric coil having a desired coil shape by turning a coil-winding mold having a winding surface with a shape including a linear portion of a predetermined length, comprising:

a linear moving mechanism for linearly moving said coil-winding mold in a direction away from said wire material feed portion by a distance corresponding to the length of said linear portion having the predetermined length, and imparting predetermined tension to said conductor wire material, when said conductor wire material is wound on said linear portion having the predetermined length, a rotary base for fixing said linear moving mechanism; and a rotary mechanism for rotating said rotary base, with said linear moving mechanism fixed thereon, when conductor wire material is wound on a portion of said winding surface other than said linear portion having the predetermined length.

7. A winding fabrication apparatus for electric coils according to claim 6, which further comprises a pressure roller for rolling said conductor wire material towards said coil-winding mold when said conductor wire material is wound on said winding portion of said coil-winding mold.

* * * * *